US005868227A

United States Patent [19]

Garcia

[11] Patent Number: 5,868,227

[45] Date of Patent: Feb. 9, 1999

[54] CARRY PACK FOR DIAPERS AND ACCESSORIES

[76] Inventor: Geralyn Garcia, 2529 Saratoga Ct., Palmdale, Calif. 93551

[21] Appl. No.: 813,371

[22] Filed: Mar. 7, 1997

[51] Int. Cl.[6] ..... A45C 3/00; A45C 5/12

[52] U.S. Cl. ..... 190/112; 190/109; 150/106; 150/112; 206/37; 383/66

[58] Field of Search ..... 150/106, 112, 150/117; 383/66; 206/37, 38, 581; 190/109, 111, 112

[56] References Cited

U.S. PATENT DOCUMENTS

| | | | |
|---|---|---|---|
| 1,464,176 | 8/1923 | Freund | 150/117 |
| 1,617,629 | 2/1927 | Gale | 150/117 X |
| 2,533,850 | 12/1950 | Syracuse | 150/117 |
| 2,844,141 | 7/1958 | Daugherty | 190/111 X |
| 3,202,191 | 8/1965 | Kaplan | 150/117 |
| 3,732,955 | 5/1973 | Carter et al. | 190/111 X |
| 3,759,356 | 9/1973 | Bostick et al. | 190/111 |
| 3,963,102 | 6/1976 | Carp | 190/111 X |
| 4,720,378 | 1/1988 | Finkel et al. | 206/38 X |
| 4,781,277 | 11/1988 | Lim | 190/111 X |
| 4,883,675 | 11/1989 | Wernz | 383/66 X |
| 4,966,286 | 10/1990 | Muckenfuhs | 383/66 X |
| 5,054,619 | 10/1991 | Muckenfuhs | 383/66 X |
| 5,443,161 | 8/1995 | Jonese | 206/38 X |

FOREIGN PATENT DOCUMENTS

| | | | |
|---|---|---|---|
| 949194 | 8/1949 | France | 150/106 |
| 1156412 | 5/1958 | France | 150/117 |

*Primary Examiner*—Sue A. Weaver
*Attorney, Agent, or Firm*—Dennis W. Beech

[57] ABSTRACT

The carry pack is a rectangular shaped bag having a top compartment and a bottom compartment. The bottom compartment is sized to carry baby diapers in a quantity desired by the user. The top compartment is sized to carry a body wipe container usually of plastic with its cover. The user may then remove the diapers as needed from the bottom compartment through a side opening and remove body wipes by opening the cover or through opening provided in the body wipe container. An alternate version has only a diaper compartment with a side opening for access. The carry pack normally has a carry strap with buckle attached to the top.

4 Claims, 5 Drawing Sheets

CARRY PACK FOR DIAPERS AND ACCESSORIES

BACKGROUND OF THE INVENTION

1. FIELD OF THE INVENTION

This invention relates to devices used to carry human baby care articles such as diapers, body wipes and other accessories. The new device provides an efficient, accessible means to carry diapers, body wipes and other articles in a manner to allow the user to easily retrieve the article when caring for the baby.

2. DESCRIPTION OF RELATED ART

There are currently in use many different types of carrying packs or bags. Common examples include the simple grocery bag whether of paper, plastic or cloth, the tote bag which includes carry handles and all manner of back packs. Often disposable diapers when sold are contained in a closed plastic wrap which has plastic carry handles.

The common small plastic hand tissue dispensers as well as some diaper packages have provision for opening a slit to allow removal of one article at a time. However, none of these carrying devices provide for the ease of removal of a combination of types of articles by the user.

The present invention provides a simple method to carry a quantity of baby diapers and body wipes in the same bag yet allow ease of access to either article as needed. This eliminates stacking one or the other on top as in the common tote bag such that ease of access is lacking. The organization overcomes the common problem with diaper bags in which articles are placed side by side or one on top of the other, but the bag is then closed at the top which detracts from ease of access to the articles.

SUMMARY OF THE INVENTION

A primary objective of the present invention is to provide a means to carry a quantity of baby diapers and body wipes simultaneously while allowing ease of access to either article as needed. Another object is to allow the carry pack to be carried or hung in a convenient manner on a variety of shapes of devices. A further object is to provide for carrying of other accessory items associated with baby care. Another object is to provide a means to carry baby care articles and provide ease of access from the side of the carry pack.

In accordance with the description presented herein, other objectives of this invention will become apparent when the description and drawings are reviewed.

DESCRIPTION OF THE PREFERRED EMBODIMENT

Figure 1:
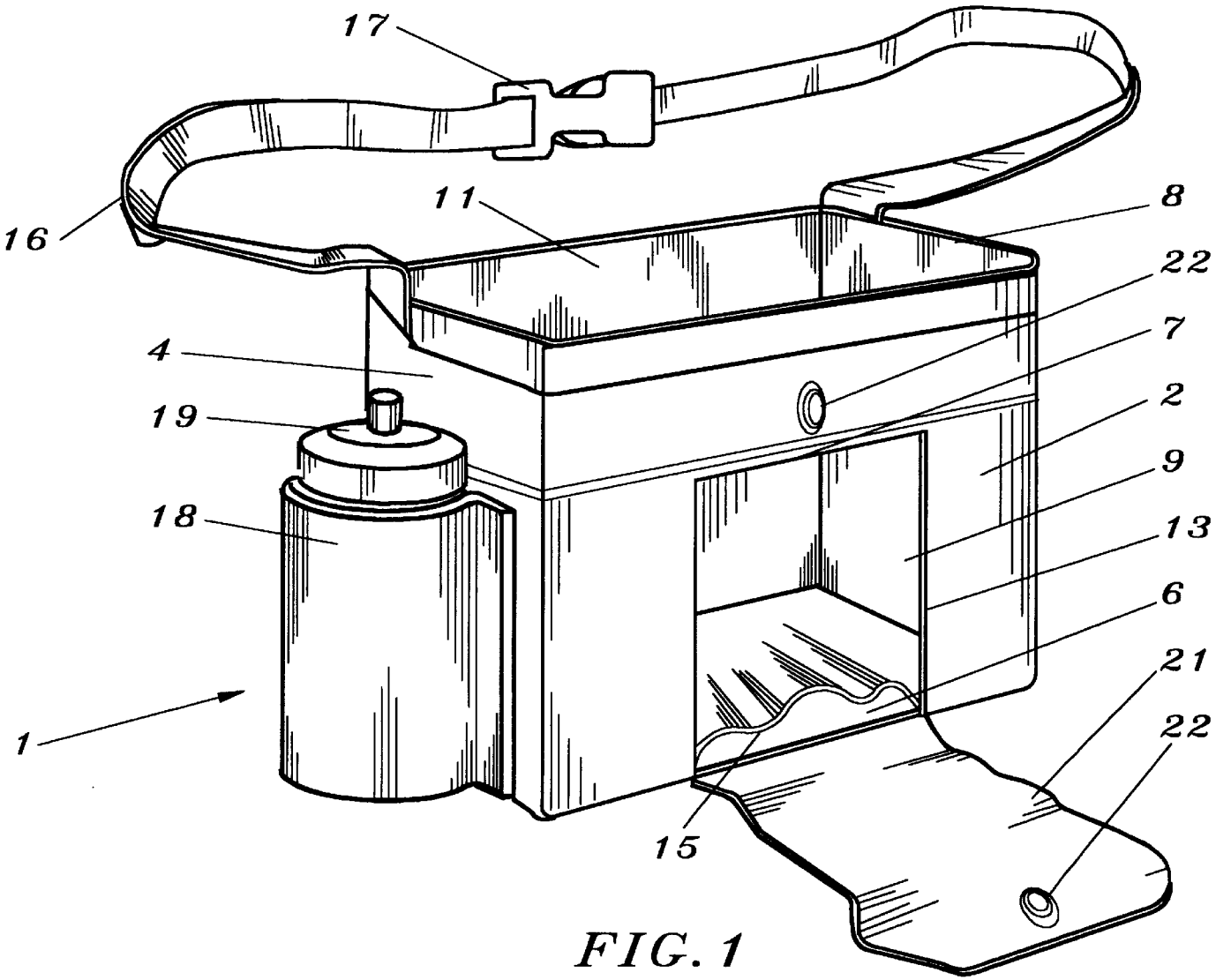
FIG. 1 illustrates a front perspective elevation view of the carry pack.
Figure 2:
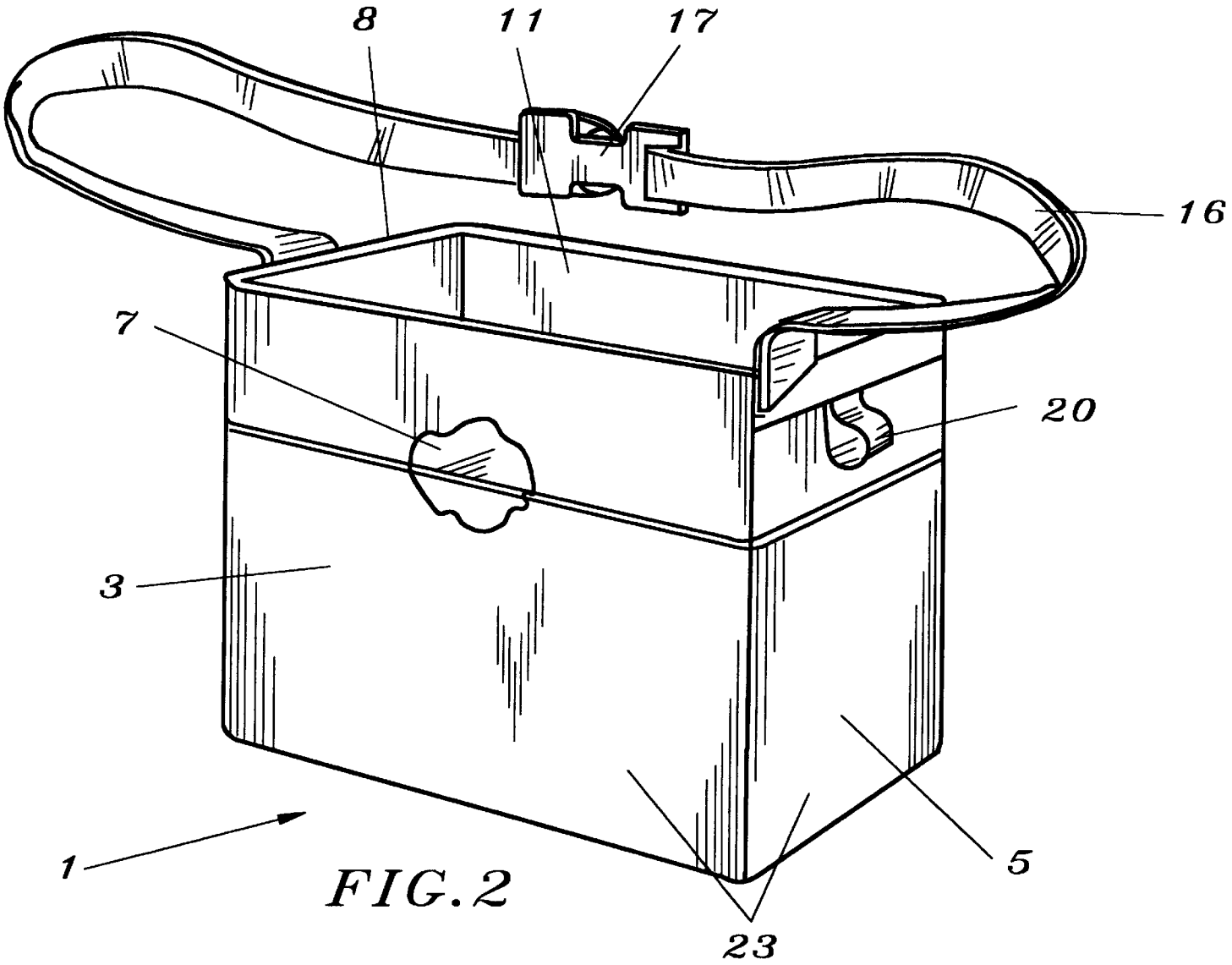
FIG. 2 illustrates a back perspective elevation view of the carry pack.

The carry pack consists of a generally rectangular shaped container having a top bag like compartment and a bottom compartment with a side opening. An alternate version of the carry pack only has one compartment with a side opening. The carry pack may be made of cloth, plastic or other suitable material. A handle or strap is attached to the top for carrying and to hang the pack over seats, strollers and other devices. A quick disconnect buckle with provision for strap length adjustment is preferred.

Referring to FIGS. 1 through 4, the carry pack (1) is a generally rectangular shape having connected sides (23) comprising a front side (2), back side (3), right side (4) and left side (5). There is a bottom panel (6) and intermediate panel (7) with the top (8) being open. The carry pack (1) may be viewed as comprising two compartments with the bottom compartment (9) shaped to carry diapers (10) and the top compartment (11) shaped to carry body wipes (12).

In normal use diapers (10) are stacked in the bottom compartment (9) through side opening (13). They may then be easily removed one at a time for use. The body wipes (12) may be placed in the top compartment (11) while still in their container (14). This allows the body wipes (12) to remain uncontaminated in the closed container (14) until needed by the user. In this arrangement a body wipe (12) or diaper (10) may be removed when needed even if the user may only have one hand free.

Figure 3:
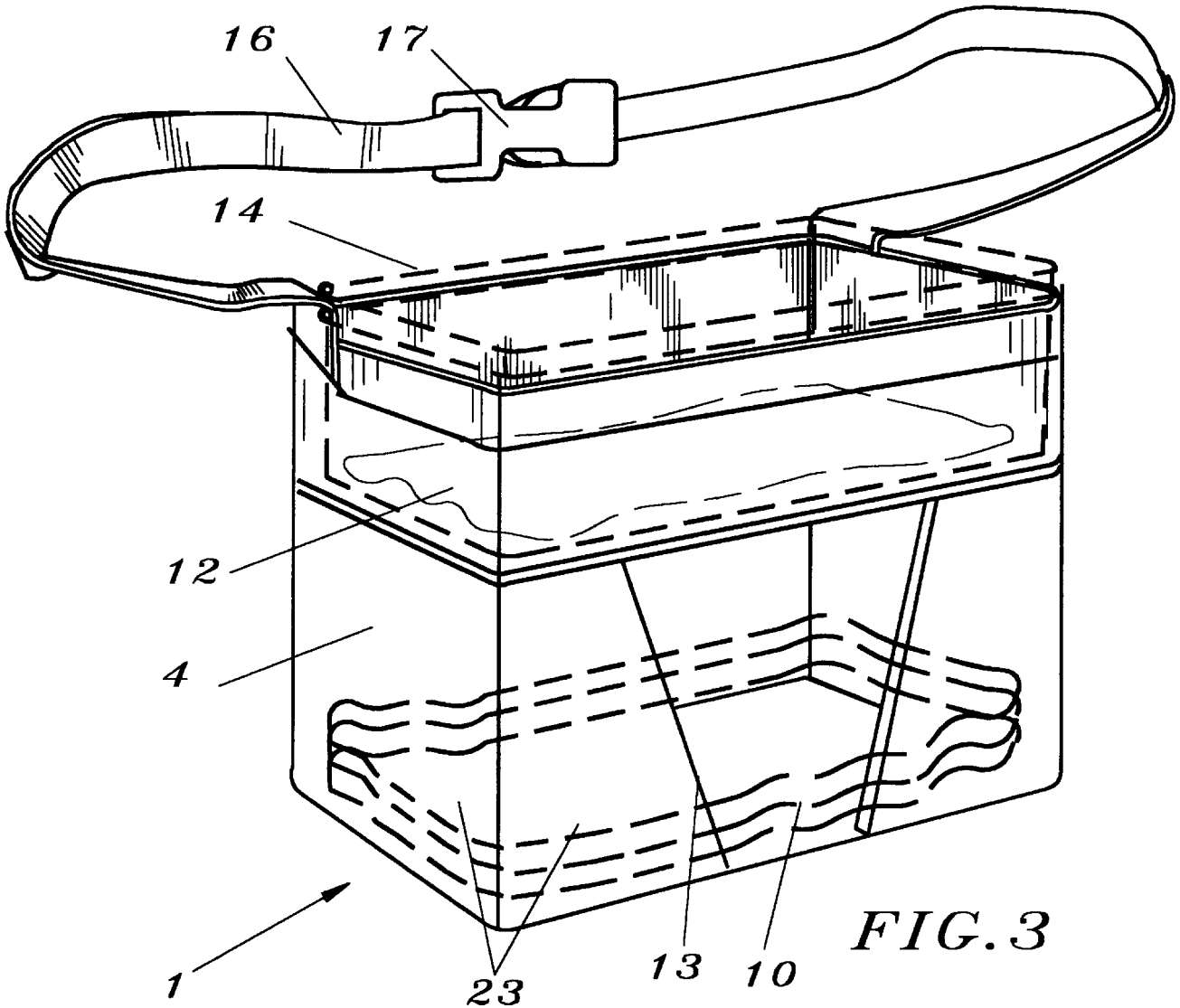
FIG. 3 illustrates a front perspective elevation view with body wipe container and with an alternate opening.
Figure 4:
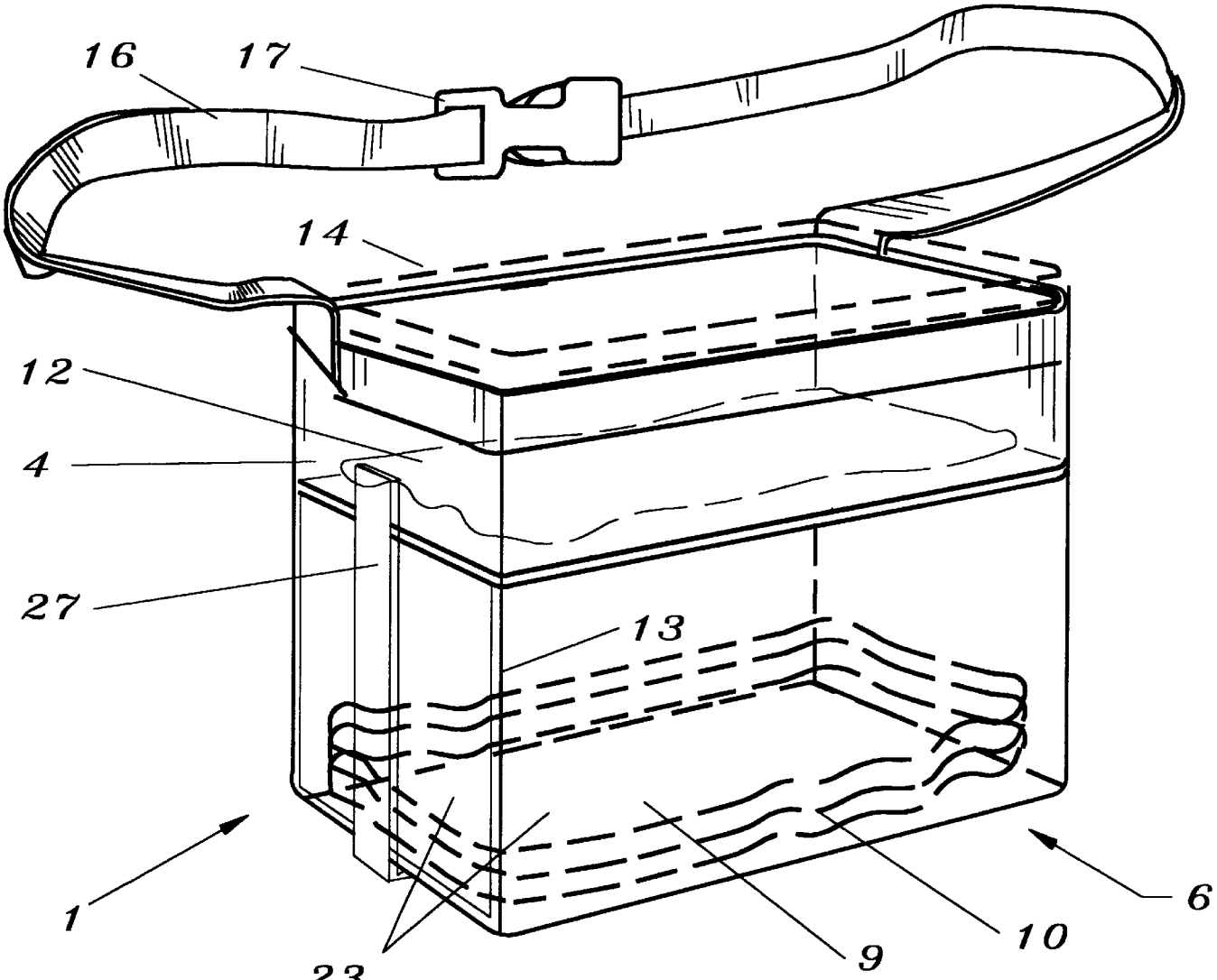
FIG. 4 illustrates a front perspective elevation view of a carry pack with alternate located side opening.

The shape of the side opening (13) may be of any suitable shape which allows access and also retains the diapers in the carry pack (1). The side opening (13) may also be located in any one or more of the sides (2, 3, 4 or 5) as FIGS. 3 and 4 are only illustrative of possible locations. The bottom compartment (9) may also have a second bottom panel (15) to allow insertion of articles such as tissues or clothing under the diapers (10) yet be kept separate for access.

The carry pack (1) in the preferred embodiment has an adjustable carry strap (16) attached at the top (8). Also included is a quick disconnect buckle (17) for ease of use. This provides for hanging the carry pack (1) on various devices such as the back of an automobile seat, a stroller and other such devices.

Other elements may be added for carrying articles such as a pocket (18) to carry a baby bottle (19) and a means for attachment (20), such as, a D-ring, hook and loop, snap, zipper or other such device for attachment of objects such as keys.

The side opening (13) may also have a retainer which may be a flap cover (21) or a strap (27) which is attached by means of snaps (22), hook and loop (28) or other suitable attachment. In an adverse environment the flap cover (21) would protect the diapers (10) from contamination.

Figure 5:
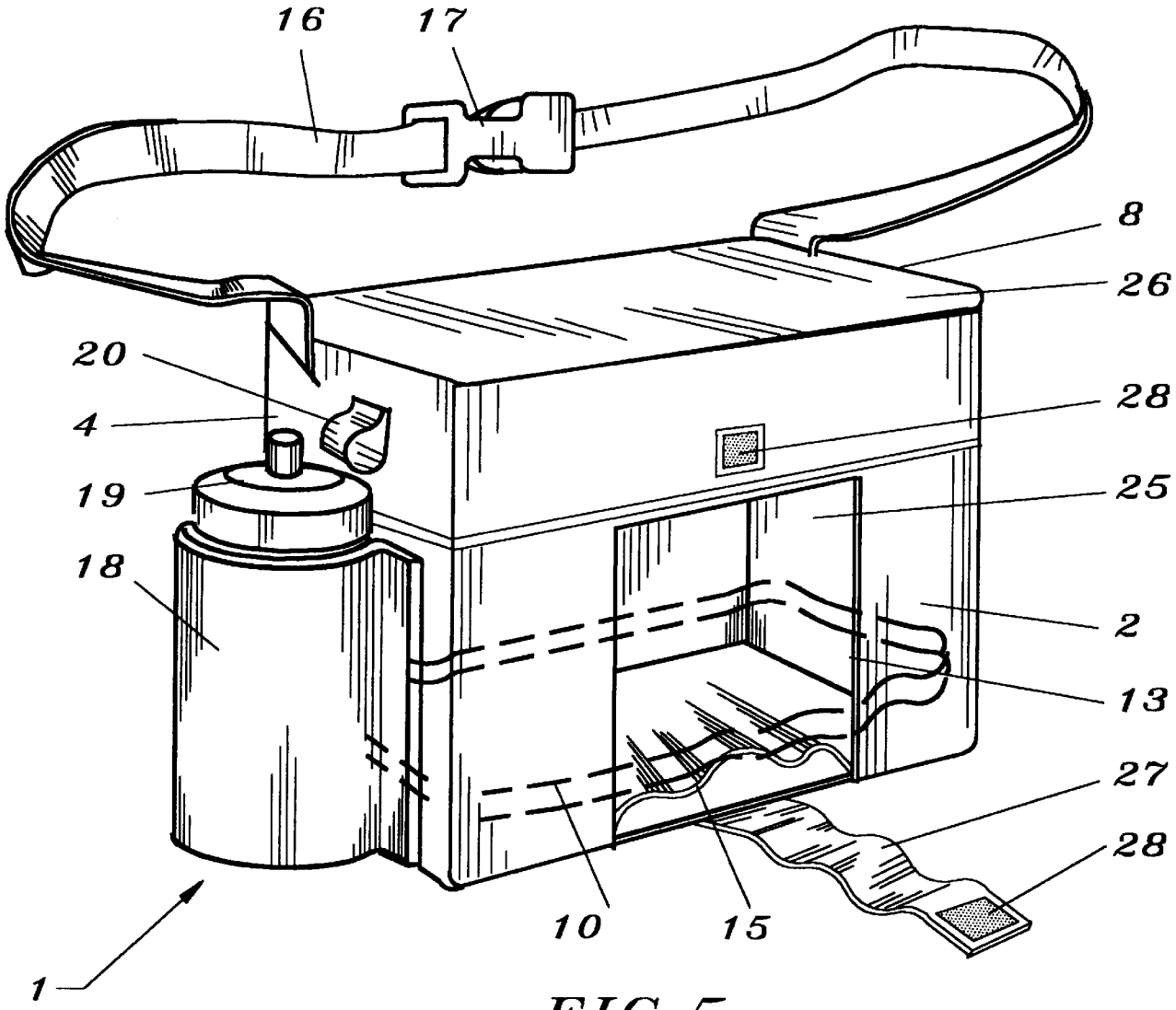
FIG. 5 illustrates a front perspective view of the carry pack without a top compartment.

FIG. 5 illustrates an alternate embodiment of the carry pack (1) which eliminates the top compartment (11) and is enclosed at the top (8) by a top panel (26). In this configuration diapers (10) and other articles are carried in the diaper compartment (25) and accessed by the side opening (13).

I claim:

1. A device for carrying baby articles comprising:

a carry pack having a front side, a back side, a right side, and a left side attached in a rectangular configuration with horizontal width and length to receive a plurality of diapers and closed by a bottom panel;

an intermediate panel parallel to the bottom panel and intermediate the bottom panel and a top without a closure thereby forming a top compartment having width, length and height to receive a container having a plurality of body wipes therein; and a bottom compartment formed by the bottom panel, the intermediate panel, the front side, the back side, the right side and the left side and the bottom compartment having a side opening defined therein.

2. The device as in claim 1 wherein there is a second bottom panel intermediate the bottom panel and the intermediate panel forming a storage compartment thereby.

3. The device as in claim 1 wherein the side opening has a retainer having a means for attachment.

4. A device for carrying baby care articles comprising:

a carry pack having a front side, a back side, a right side, and a left side attached in a rectangular configuration and closed by a bottom panel and a top panel forming a diaper compartment therein; and said diaper compartment having a second bottom panel intermediate the bottom panel and the top panel forming a storage compartment thereby for receiving non-diaper articles with said diaper compartment having a side opening defined therein without a closure.

* * * * *